US006513623B2

(12) United States Patent
Sugiyama et al.

(10) Patent No.: US 6,513,623 B2
(45) Date of Patent: Feb. 4, 2003

(54) SPEAKER

(75) Inventors: Shigeru Sugiyama, Sizuoka (JP); Hajime Kitamura, Sizuoka (JP); Naohiro Fujinami, Shizouka (JP); Yoshio Imahori, Shizuoka (JP); Hitoshi Yamashima, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 0 days.

(21) Appl. No.: 09/824,750

(22) Filed: Apr. 4, 2001

(65) Prior Publication Data

US 2001/0045321 A1 Nov. 29, 2001

(30) Foreign Application Priority Data

Apr. 4, 2000 (JP) ..... 2000-102800

(51) Int. Cl.[7] ..... G10K 13/00

(52) U.S. Cl. ..... 181/161; 181/157; 181/163; 181/164; 181/165; 181/171; 181/172; 181/173

(58) Field of Search ..... 181/161, 157–159, 181/163–165, 171–173

(56) References Cited

U.S. PATENT DOCUMENTS 4,031,337 A * 6/1977 Okamura et al. ..... 381/340
4,239,090 A * 12/1980 Dahlquist ..... 181/172
4,263,435 A 4/1981 Takahashi
4,315,112 A * 2/1982 Hofer ..... 381/186
4,399,334 A * 8/1983 Kakiuchi et al. ..... 381/189
4,441,576 A * 4/1984 Allen ..... 181/129
5,298,694 A * 3/1994 Thompson et al. ..... 181/286

OTHER PUBLICATIONS

Patent Abstracts of Japan: vol. 1996, No. 10. Oct. 31, 1996 JP 08–49595 A (Matsushita Electric Ind. Co., Ltd.), Jun. 7, 1996.

Patent Abstracts of Japan: vol. 1997, No. 09. Sep. 30, 1997, JP 09–121395 A (Matsushita Electric Ind. Co., Ltd.), May 6, 1997.

Patent Abstracts of Japan: vol. 006, No. 077 (E–106),. May 14, 1982 JP 57–013897 A (Citizen Watch Co., Ltd.), Jan. 23, 1982.

* cited by examiner

*Primary Examiner*—Shih-Yung Hsieh
(74) *Attorney, Agent, or Firm*—Sughrue Mion, PLLC

(57) ABSTRACT

A frame (14) supporting a diaphragm (12) by its outer periphery is constructed by a connecting ring (30) and a base (28) which comprises a bottomed cylinder portion (28A) and a mounting portion (28B) which extends radially outward from the bottomed cylinder portion (28A) which is a part of the magnetic circuit unit (18). The connection is achieved by the caulking of the ring (30) and the mounting portion (28B) with the diaphragm (12) clamped therebetween.

9 Claims, 8 Drawing Sheets

SPEAKER

BACKGROUND OF THE INVENTION

1. Field of the Invention

The present invention relates to a dynamic speaker, and particularly to a structure for supporting a diaphragm with a frame.

2. Description of the Related Art

As one type of a speaker, a dynamic speaker has been known heretofore. The dynamic speaker, as disclosed in, for example, JP-A-6-178390, comprises a diaphragm on which a voice coil is fixed and a frame for supporting the outer periphery of the diaphragm.

As disclosed in the publication, there is a well-known support structure, for supporting the diaphragm with the frame, that the outer periphery of the diaphragm is adhered and fixed to the frame.

However, simply adhereing and fixing the diaphragm to the frame does not provide the sufficiently reliable support structure for the diaphragm, and risk remains of the diaphragm separating from the frame during the use of the speaker. This is particularly true when the speaker is mounted in an automobile, etc. where the speaker is subject to much shock and impact load that makes the separation of the diaphragm even more likely.

Furthermore, since the speaker with the diaphragm that is attached to the frame with the adhesive requires application of the adhesive during manufacturing, the automation of the speaker manufacturing process is made difficult and is further complicated by adjusting the viscosity of the adhesives and implementing the drying process following the application of the adhesives.

SUMMARY OF THE INVENTION

An object of the present invention which has been made in light of the aforementioned problems is to provide a sure method for the prevention of the separation of the diaphragm from its frame and to simplify the speaker manufacturing process and promote its automation.

In the present invention, the object is achieved by use of a caulking structure as a support structure for supporting the diaphragm with the frame.

According to the present invention, there is provided a speaker comprising:

a diaphragm;

a magnetic circuit unit defining a cylindrical magnetic gap;

a voice coil having a first portion fixed to the diaphragm and a second portion placed in the cylindrical magnetic gap; and a frame for supporting the outer periphery of the diaphragm, wherein the frame comprises an annular ring formed along with the shape of the outer periphery of the diaphragm and a mounting portion extending radially outward from the magnetic circuit unit; and the ring and the mounting portion are caulked-jointed to each other with the diaphragm clamped therebetween.

No particular restrictions on the material used, shape and the like are imposed on the specific construction of the "diaphragm," "voice coil" or "magnetic circuit unit" so long as they can be used as constituent elements of the dynamic speaker.

No particular restrictions on the material used, shape and the like are imposed on the specific construction of the "ring" or "mounting portion" so long as both can be caulked together. Furthermore, the "mounting portion" may be separately formed or integrally formed as a constituent element of the magnetic circuit unit.

No particular restrictions are imposed on the specific method of the caulking. The methods that can be used include, for example, a cold caulking or caulking that uses thermal deformation induced by ultrasonic vibrations. Furthermore, caulking portions subject to plastic deformation may be formed either on only the ring or the mounting portion, or both.

As the afore-described construction shows, the speaker of the present,invention comprises a diaphragm which is supported by its outer periphery by a frame which comprises a ring—formed in an annulus following the outer peripheral shape of the diaphragm—that is connected to a mounting portion that extends radially outward from a magnetic circuit unit. The functions and effects described hereinbelow are obtained as a result of the caulked-joint of the ring and the mounting portion with the diaphragm clamped therebetween.

Since the diaphragm is clamped between the ring and the mounting portion which are caulked-jointed to each other the supporting strength offered by the frame to the diaphragm is significantly increased as compared to the conventional technique attaching the diaphragm to the frame using only an adhesive. This reliably prevents the diaphragm from separating from the frame during the use of the speaker.

Furthermore, since the task of applying the adhesives required with the conventional techniques is eliminated in this invention, automation of the speaker fabrication process is facilitated. Moreover, the process of adjusting the viscosity of the adhesives or drying the adhesives after their application is eliminated, further simplifying the speaker manufacturing process.

In the foregoing manner, the present invention reliably prevents the separation of the diaphragm from the frame, and promotes and facilitates the automation of the speaker manufacturing process.

Even though in the afore-described construction the diaphragm is simply clamped between the ring and the mounting portion which are caulked-jointed together, there is no risk of an acoustically detrimental deformation of the diaphragm arising from the use of the caulking construction since the diaphragm itself plays no role in the caulked-joint.

As stated previously, no restrictions are imposed on the specific caulking method. Since at least either the ring or the mounting portion is constructed of synthetic resin with a plurality of caulking portions **30*b*'** which are then thermally deformed by exposure to ultrasonic vibrations, the caulked-joint can be easily and securely performed even if the speaker were to be small with the extremely small caulking portions provided on the ring or the mounting portion.

Since the ultrasonic vibrations are used for the thermal deformation of the caulking portions without a need for an ultrasonic welding of the ring and the mounting portion, there is no need to give any consideration to the welding compatibility of the materials used for the two pieces. This means that the use of a thermal deformation induced by exposure to ultrasonic vibrations imposes no limitations on the degree of freedom in the selection of the materials to be used for the ring and the mounting portion. Needless to say, the degree of freedom in the selection of the material for the diaphragm is not restricted in anyway since the diaphragm plays no role in the caulked-joint.

In addition to the afore-described construction, the following effects and function are obtained if the ring is caulked-jointed to the diaphragm by the plastic deformation of the caulking portions formed on the ring.

The ring is temporarily fixed to the diaphragm before the ring and the mounting portion are caulked-jointed. This allows the diaphragm to be positioned at its predetermined position when it is clamped down by the caulking of the two pieces. If the caulking is used for the temporary attachment, the diaphragm can be positioned without impeding the automation or the simplification of the speaker manufacturing process.

Moreover, since the plastic deformation of the ring 30 is accomplished by the thermal deformation of the caulking portions 30*d*' on the ring 30 by their exposure to ultrasonic vibrations, the same effects and functions are obtained as provided with the use of ultrasonic vibrations for the caulked-joint of the ring and the mounting portion.

Furthermore, the following functions and effects are obtained if, in the construction described above, at least either the ring or the mounting portion is formed with circumferential direction positioning piece which determines the circumferential positioning of the ring and the mounting portion.

The mounting portion must be provided with openings for lead wires so that the lead wires of the voice coil that is attached to the diaphragm may be connected to the terminals. The caulked-joint of the ring and the mounting portion must be done at angular positions that are different from where the lead wires will be drawn out. If the afore-described circumferential direction positioning piece is formed to position the ring and the mounting portion in the circumferential direction, the caulked-joint of the two pieces can be reliably done at the prescribed angular positions. In particular, since, if the ring is caulked to the diaphragm in advance, the caulked-joint of the ring and the mounting portion must be done at angular positions that are different from where the ring is caulked to the diaphragm, the formation of the afore-described circumferential direction locating piece is particularly effective.

Incidentally, if the afore-described construction of temporarily fixing the ring by the caulking is used (that is, the caulking of the ring to the diaphragm by the plastic deformation of the caulking portions which are formed on the ring), the diaphragm will be clamped at the right position between the ring and the mounting portion regardless of whether the ring and the mounting portion in jointed by caulking or otherwise (for example by an adhesive).

Furthermore in this case, the same functions and effects are obtained if, instead of the ring being temporarily fixed by caulking, the mounting portion is temporarily fixed by caulking (that is, the caulking of the mounting portion to the diaphragm by the plastic deformation of the protrusions which are formed on the mounting portion).

DETAILED DESCRIPTION OF THE PRESENT INVENTION

The present invention will be described below in detail with reference to the accompanying drawings.

Figure 1:
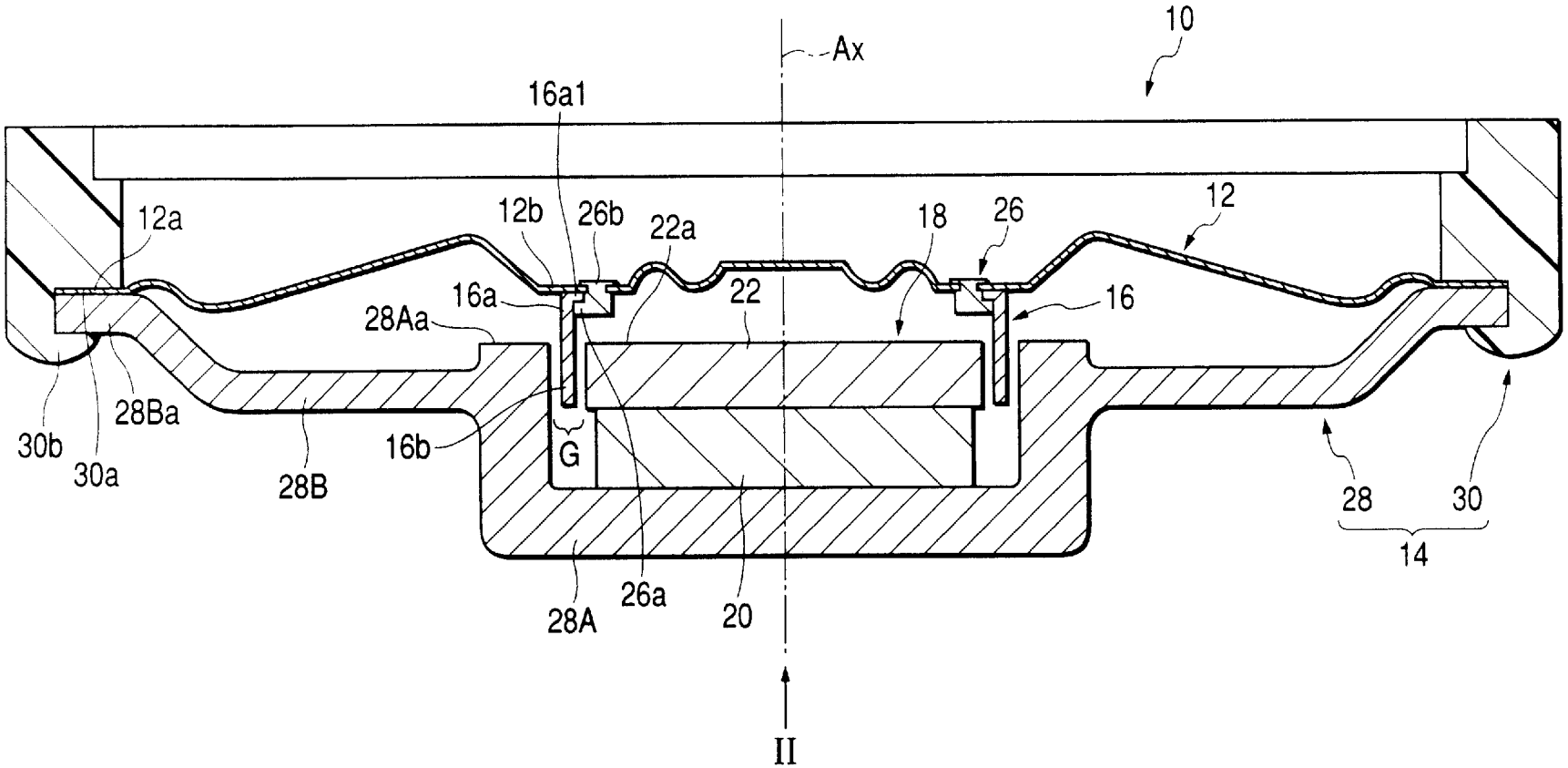
FIG. 1 is a sectional view showing a speaker, oriented in an upwardly direction, according to an embodiment of the present invention.
Figure 2:
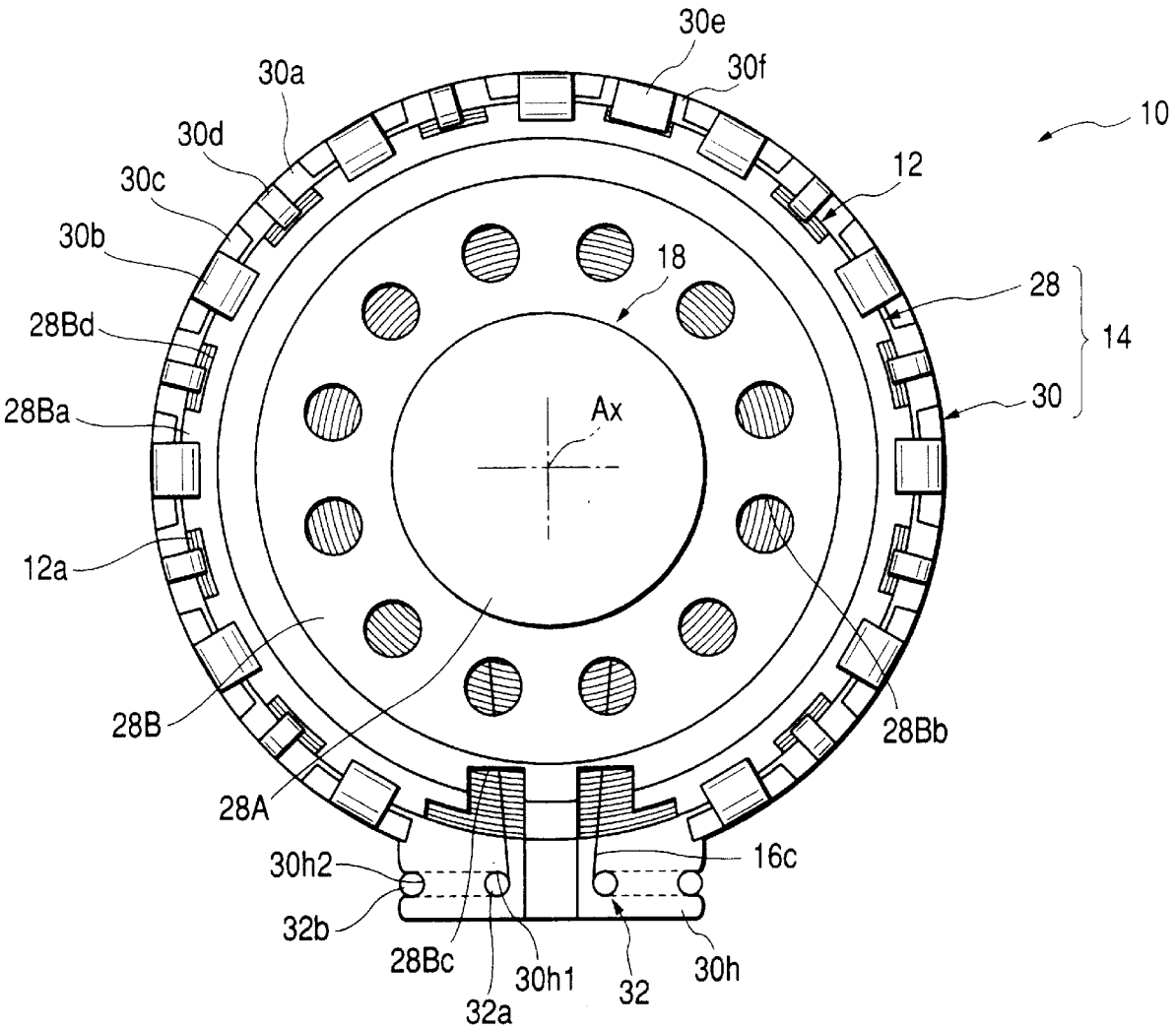
FIG. 2 is a view seen from the direction of arrow II in FIG. 1.

FIG. 1 is a side sectional view showing a speaker 10 according to an embodiment of the invention, in which the speaker faces upward. FIG. 2 is a view seen from the direction of arrow II.

As shown in FIG. 1, the speaker 10 according to the embodiment is a dynamic speaker comprising a diaphragm 12, a frame 14, a voice coil 16 and a magnetic circuit unit 18. This speaker 10 is a small-sized speaker having an outer diameter of about 30 mm, and used as, for example, a generator of alarm or the like, which is mounted on a base plate in a state where it has been stored in a case (not shown) and loaded on an automobile or the like.

The diaphragm 12 is a member having a plurality of unevenness formed concentrically, and the diaphragm 12 is formed by applying heat-press molding to a synthetic resin film. A peripheral edge flat portion 12*a* of the diaphragm 12 and an intermediate flat portion 12*b* are located on the same horizontal annular plane.

With the voice coil 16 positioned with respect to the central axis Ax of the speaker 10 to be concentric with the diaphragm 12, an upper end portion 16*a* (one end) of the voice coil 16 is secured to the intermediate flat portion 12*b* of the diaphragm 12 by a coil supporting member 26.

A flange portion 16*a*1 protruding inward in the radial direction is formed at the upper end portion 16*a* of the voice coil 16. On the other hand, an engaging portion 26*a* is formed at a lower end portion of the coil supporting member 26. The engaging portion 26*a* engages with the flange portion 16*a*1 of the voice coil 16. Further, at an upper end portion of the coil supporting member 26, a caulk-fixed portion 26*b* is formed, which is caulked to be fixed to the intermediate flat portion 12*b* of the diaphragm 12. And, the flange portion 16*a*1 of the voice coil 16 are interposed between the engaging portion 26*a* of the coil supporting member 26 and the intermediate flat portion 12*b* of the diaphragm 12 and held by them from upper and lower sides, whereby the voice coil 16 is fixed to the diaphragm 12

The frame 14 is formed by connecting a base 28 made of steel with a ring 30 made of a synthetic resin.

The base 28 comprises a bottomed cylinder portion 28A located in the center and an annular mounting portion 28B that extends radially outward from the vicinity of the upper end portion on the outer surface of the bottomed cylinder portion 28A. The outer diameter of the mounting portion 28B is approximately equal to that of diaphragm 12. An annular flat portion 28B*a* located higher than the top surface 28A*a* of the bottomed cylinder portion 28A is formed along the outer periphery of the mounting portion 28B. A plurality of through holes 28B*b* are formed on the mounting portion 28B at predetermined intervals in the circumferential direction as shown in FIG. 2.

The ring 30 being annular and being formed to follow the outline of the outer periphery of diaphragm 12 is caulked and fixed to the mounting portion 28B so as to hold the peripheral edge flat portion 12*a* of the diaphragm 12 between the lower face 30*a* of the ring 30 and the annular flat portion 28B*a* of the mounting portion 28B of the base 28. The ring 30 is caulked and fixed to the peripheral edge flat portion 12*a* of the diaphragm 12. Details of the caulking structure will be described later.

The magnetic circuit unit 18 includes the bottomed cylinder portion 28A of the frame 14, a magnet 20 and a steel yoke 22. Both of the magnet 20 and yoke 22 are formed in the shape of a disk, placed on a bottom surface of the bottomed cylinder portion 28*a* in this order so as to be concentric with each other, and bonded and fixed to the frame 14. The magnetic circuit unit 18 is so set that an upper end surface 22*a* of the yoke 22 has substantially the same height as the upper end surface 28A*a* of the bottomed cylinder portion 28A, and a cylindrical magnetic gap G is formed, between the outer surface of the yoke 22 and the inner surface of the bottomed cylinder portion 28A, with the same width in whole. And, in the cylindrical magnetic gap G, a lower portion 16*b* (the other end portion) of the voice coil 16 is placed.

As shown in FIG. 2, a flange 30*h* for installing terminals is formed on the ring 30, and a pair of terminal pins 32 are fixed to the flange 30*h*. The terminal pins 32 are formed substantially in the shape of the letter "J" with a short leg 32*a* and a long leg 32*b*. The short leg 32*a* is press-inserted into a terminal support hole 30*h*1 formed in the flange 30*h*, and the long leg 32*b* engages with a terminal engagement groove 30*h*2 formed in the flange 30*h*. Both ends of a pair of lead wires 16*c* extending from the voice coil 16*c* are wrapped around and secured to the short legs 32*a* of the terminals pins 32.

A pair of cut-away portions 28B*c* for extending the lead wires are formed along the outer periphery of the mounting portion 28B at positions corresponding to the flange 30*h* to allow the extension of the lead wires 16*c* outward.

The ring 30 is caulked-jointed to the mounting portion 28B by wider caulking portions 30*b* that are formed on the ring 30. Eleven caulking portions are formed in 30° circumferential intervals except where the flange 30*h* is located. Each of the caulking portions 30*b* is formed on the bottom surface of the projection 30*c* formed on the lower surface 30*a* of the ring 30 which protrude by the thickness corresponding to that of the annular flat portion 28B*a*.

The ring 30 is caulked-jointed to diaphragm 12 by a narrower caulking portions 30*d* that are formed along the lower surface 30*a* of the ring 30. Alternating with the wider caulking portions 30*b*, nine such narrower caulking portions 30*d* are formed in 30° circumferential intervals—excluding the circumferential section where the flange 30*h* is formed and the circumferential section substantially opposite thereto in the diameter direction.

Ten cut-away portions 28B*d*, each located 30° apart in the circumferential direction, are formed along the outer periphery of the mounting portion 28B so as to provide a caulking space between the diaphragm 12 and the narrower caulking portions 30*d* of the ring 30.

A circumferential direction positioning piece 30*e* is formed on the lower surface 30*a* of the ring 30 at a location substantially opposite in the diameter direction to the flange 30*h* where the narrower caulking portions 30*d* are not formed. The circumferential direction positioning piece 30*e*, which is a rectangular tab that protrudes radially inward with a width slightly less than that of the cut-away portions 28B*d* formed in the mounting portion 28B, engages with the cut-away portion 28B*d* so as to position the ring 30 and the mounting portion 28B in the circumferential direction.

The manufacturing process of the speaker 10 according to the embodiment will be described.

Figure 3:
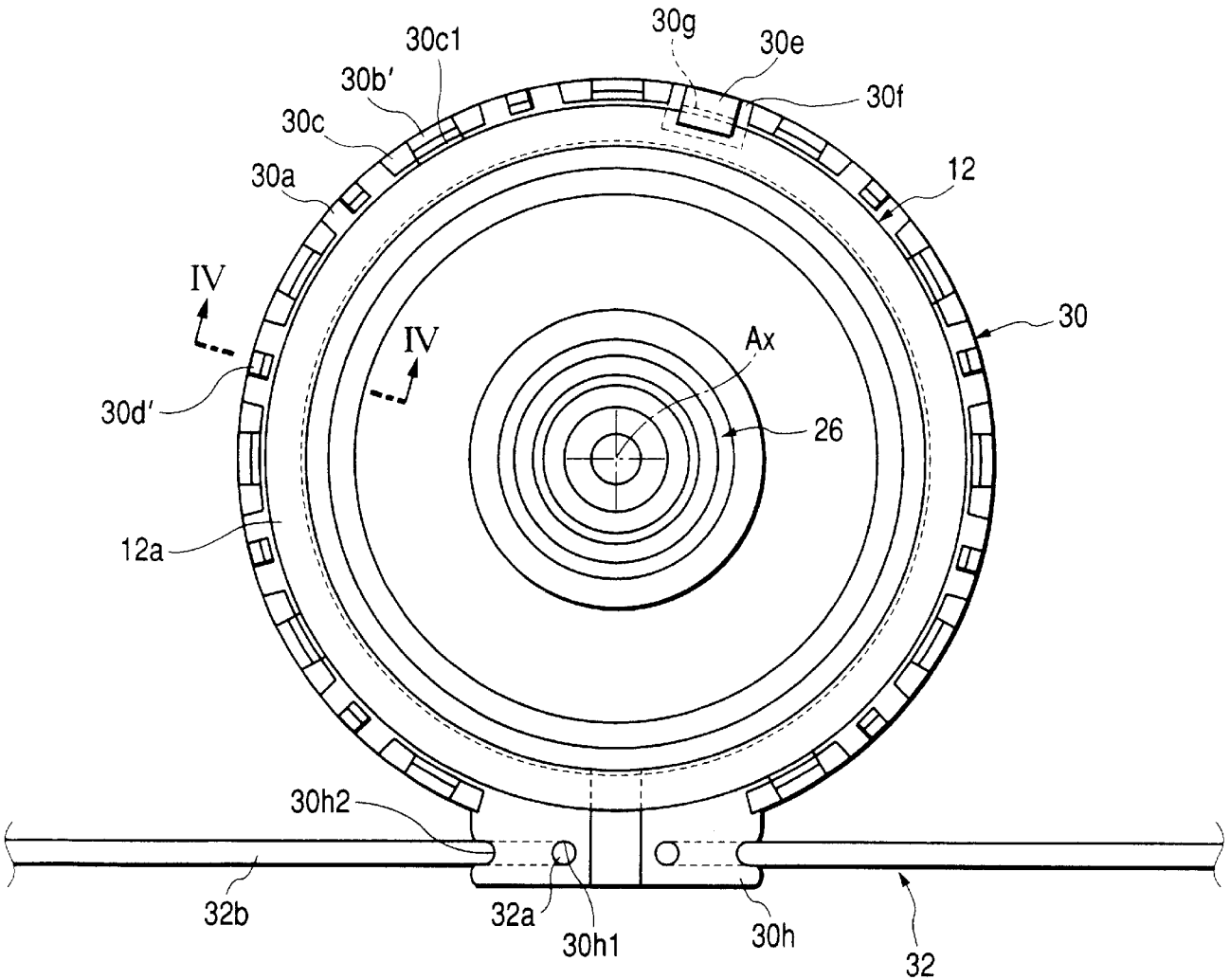
FIG. 3 is a figure similar to FIG. 2 and showing a manufacturing process (part 1) of the speaker of the embodiment.

First, as shown in FIG. 3, the diaphragm 12 with the coil supporting member 26 caulked-jointed thereto in advance is set on the ring 30 that has been disposed upside down. That is, the peripheral edge flat portion 12*a* of the diaphragm 12 is placed on the lower surface 30*a* of the ring 30. At this time, since the top of the circumferential direction positioning piece 30*e* is located higher than the diaphragm 12, the peripheral edge flat portion 12*a* of the diaphragm 12 is inserted under the top of the positioning piece 30*e* from the inner peripheral side.

Figure 5:
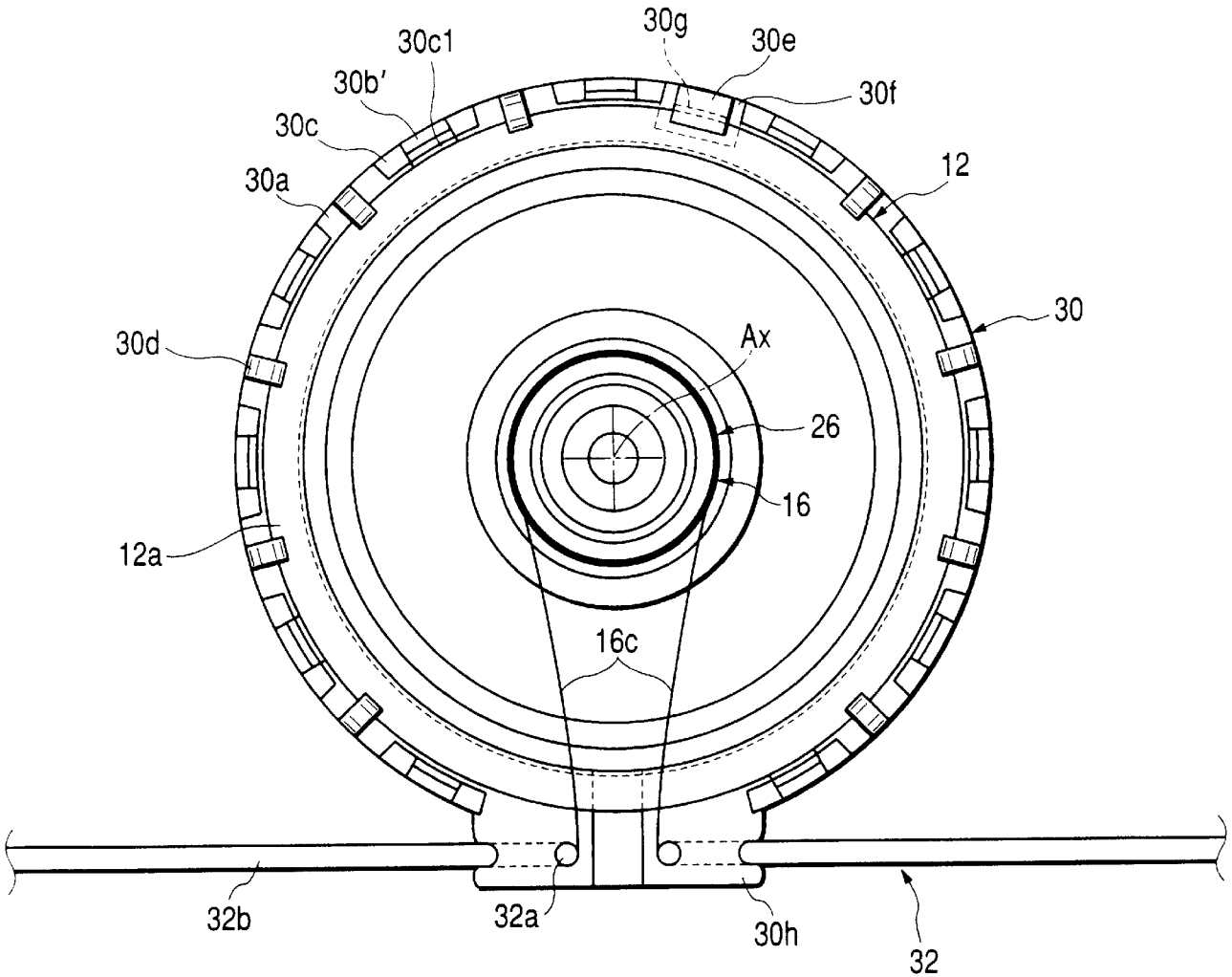
FIG. 5 is a figure similar to FIG. 2 and showing a manufacturing process (part 2) of the speaker of the embodiment.
Figure 6:
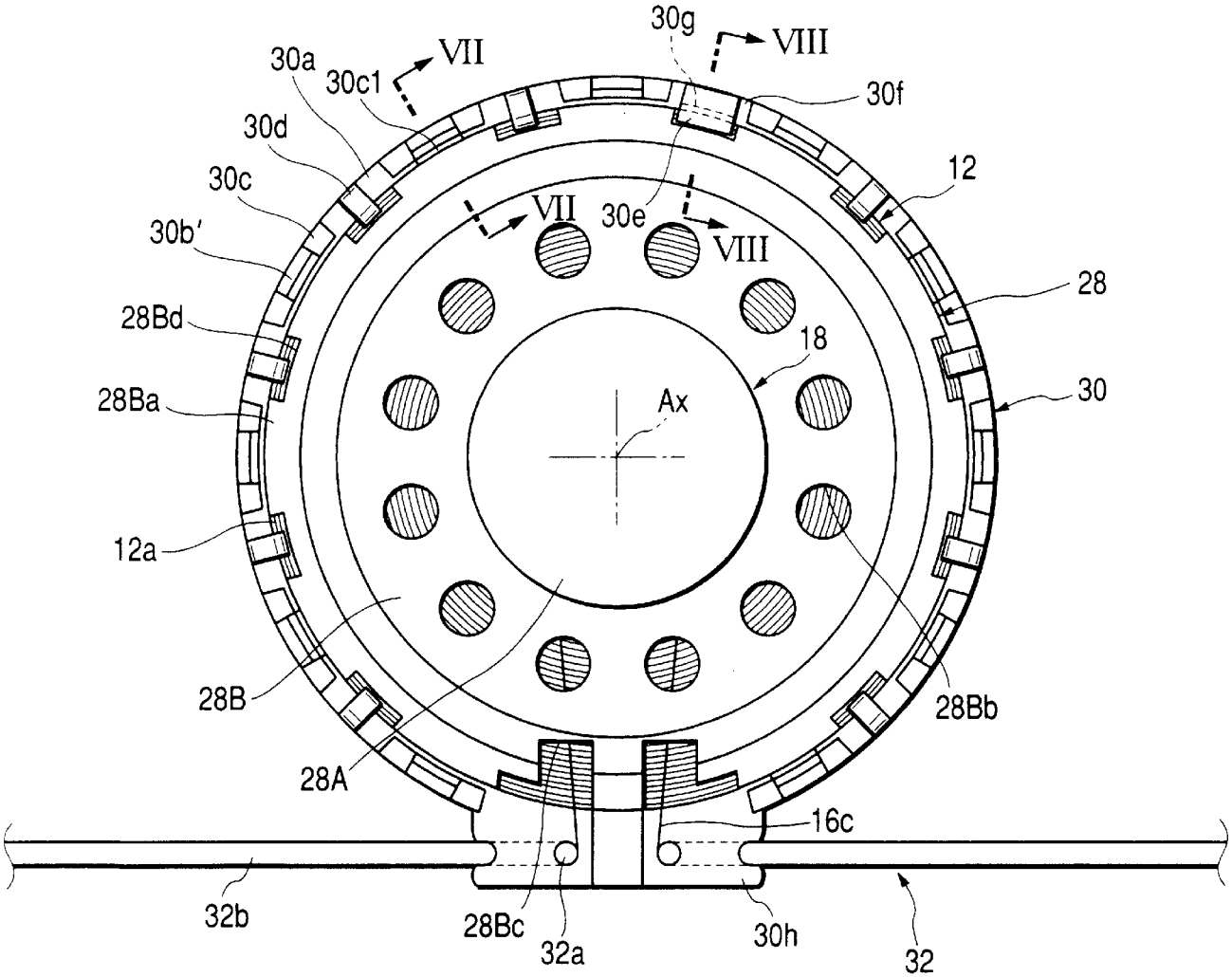
FIG. 6 is a figure similar to FIG. 2 and showing a manufacturing process (part 3) of the speaker of the embodiment.

In FIG. 2, the diaphragm 12 is shown with hatched lines so as to show the diaphragm 12 clearly. The hatching is not shown in FIG. 3. (FIG. 5 and FIG. 3 are similar in this regard. FIG. 6 and FIG. 2 are also similar in this regard.)

As shown in FIG. 3, the inner diameter of the projections 30*c* is slightly larger than the outer diameter of the diaphragm 12. Among the projections 30*c*, the four projections 30*c* which are formed with 90 intervals are provided with the radial direction positioning pieces 30*c*1 which are formed to protrude slightly more inward in the radial direction than the inner peripheral surface of the projections 30*c* so that the inner diameter of the positioning pieces 30*c*1 is the same as the outer diameter of the diaphragm 12. This ensures that the diaphragm 12 is set against the ring 30 with a correct positional relationship.

At this stage, with respect to the individual terminal pins 32, the long legs 32*b* are still extended in the horizontal direction.

Figure 4:
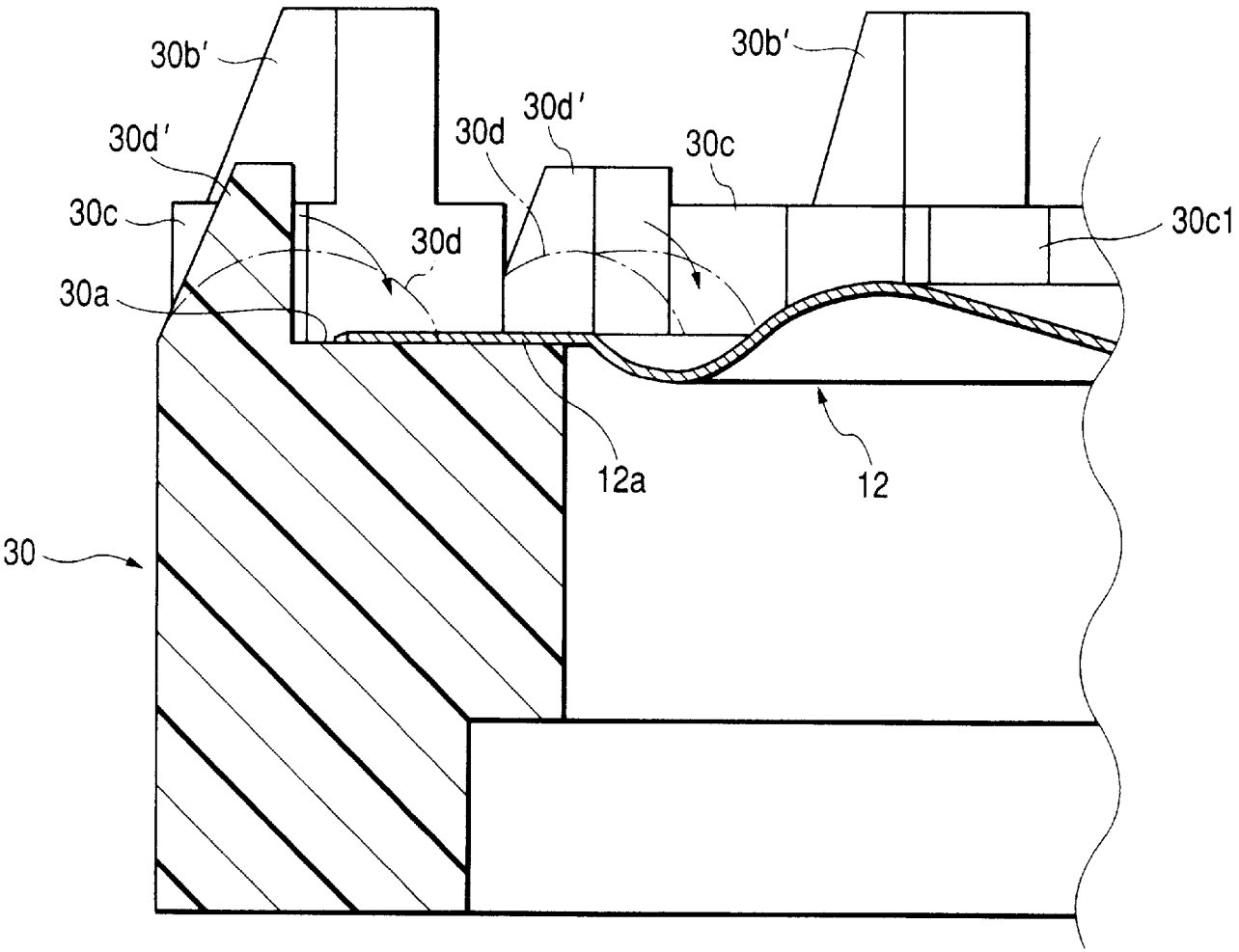
FIG. 4 is a detailed sectional view taken along line IV-IV in FIG. 3.

Next, the ring 30 is caulked-jointed to the diaphragm 12 to temporarily attach the diaphragm 12 with the ring 30. The caulking is achieved by a plastic deformation of the respective caulking portion 30*d*' on the ring 30 to be turned into the caulking portion 30*d* as shown in FIG. 4. The plastic deformation is achieved by a thermal deformation of the caulking portion 30*d*' by exposure to ultrasonic vibrations.

The voice coil 16 is then wound around the coil supporting member 26 as shown in FIG. 5, and the ends of the pair of lead wires 26*c* extending out from the voice coil 16 are wound around and fixed to the short legs 32*a* of the pair of terminal pins 32.

After the winding and fixing are completed, the mounting portion 28B (base 28) is set to the ring 30 as shown in FIG. 6. When doing this, the cut-away portions 28B*d* in the mounting portion 28B are engaged with the circumferential direction positioning pieces 30*e* of the ring 30, and the outer peripheral surface of the mounting 28 is made to contact the radial direction positioning pieces 30*c*1 of the ring 30 so that the mounting portion 28B is correctly positioned with respect to ring 30.

Figure 7:
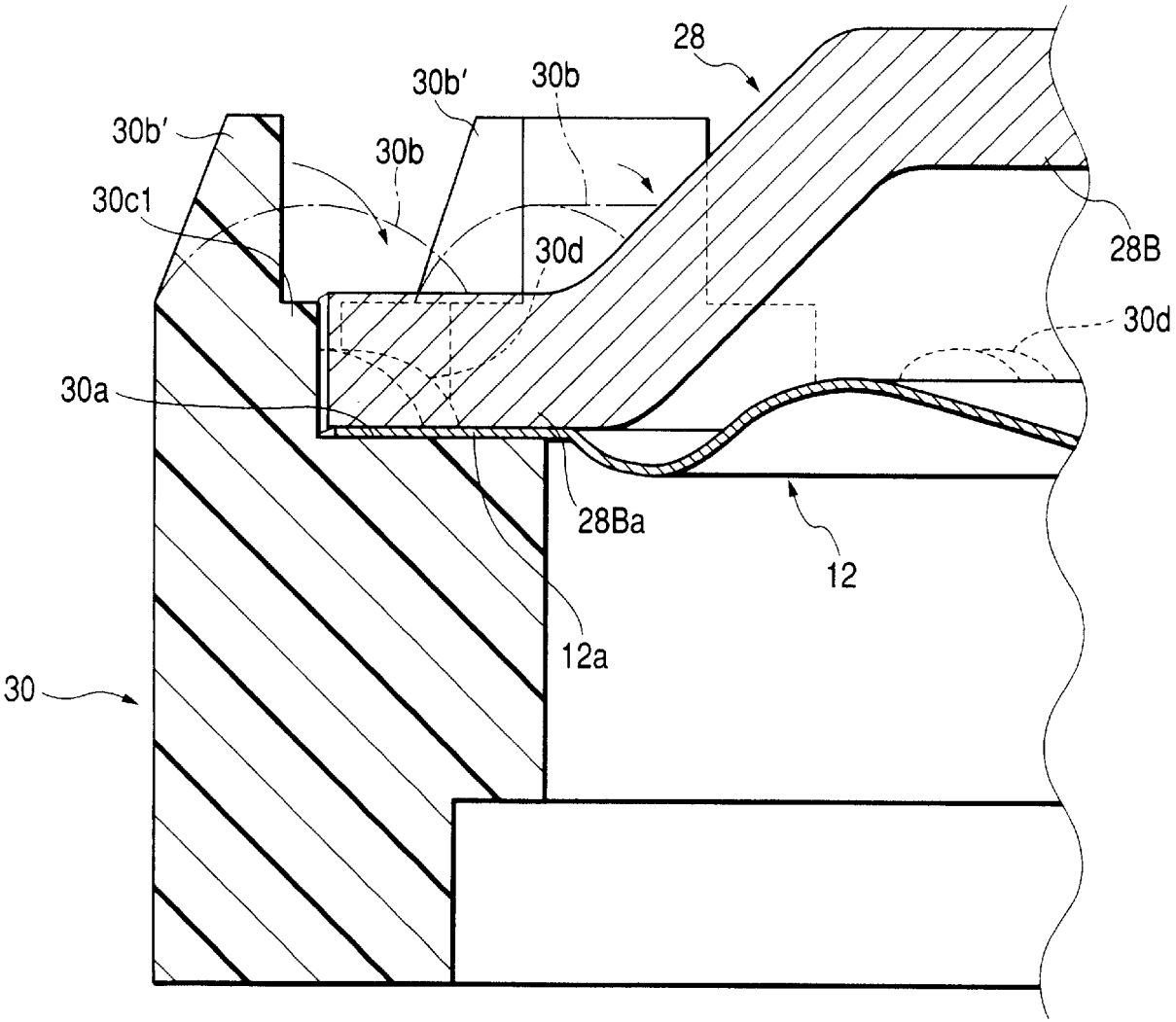
FIG. 7 is a detailed sectional view taken along line VII-VII in FIG. 6.

Next, the ring 30 is caulked-jointed to the mounting portion 28B. The caulking is achieved by a plastic deformation of the respective caulking portion 30*b*' on the ring 30 to be turned into the caulking portion 30*b* as shown in FIG. 7. The plastic deformation is achieved by a thermal deformation of the caulking portion 30*b*' achieved by exposing the ultrasonic vibrations.

Figure 8:
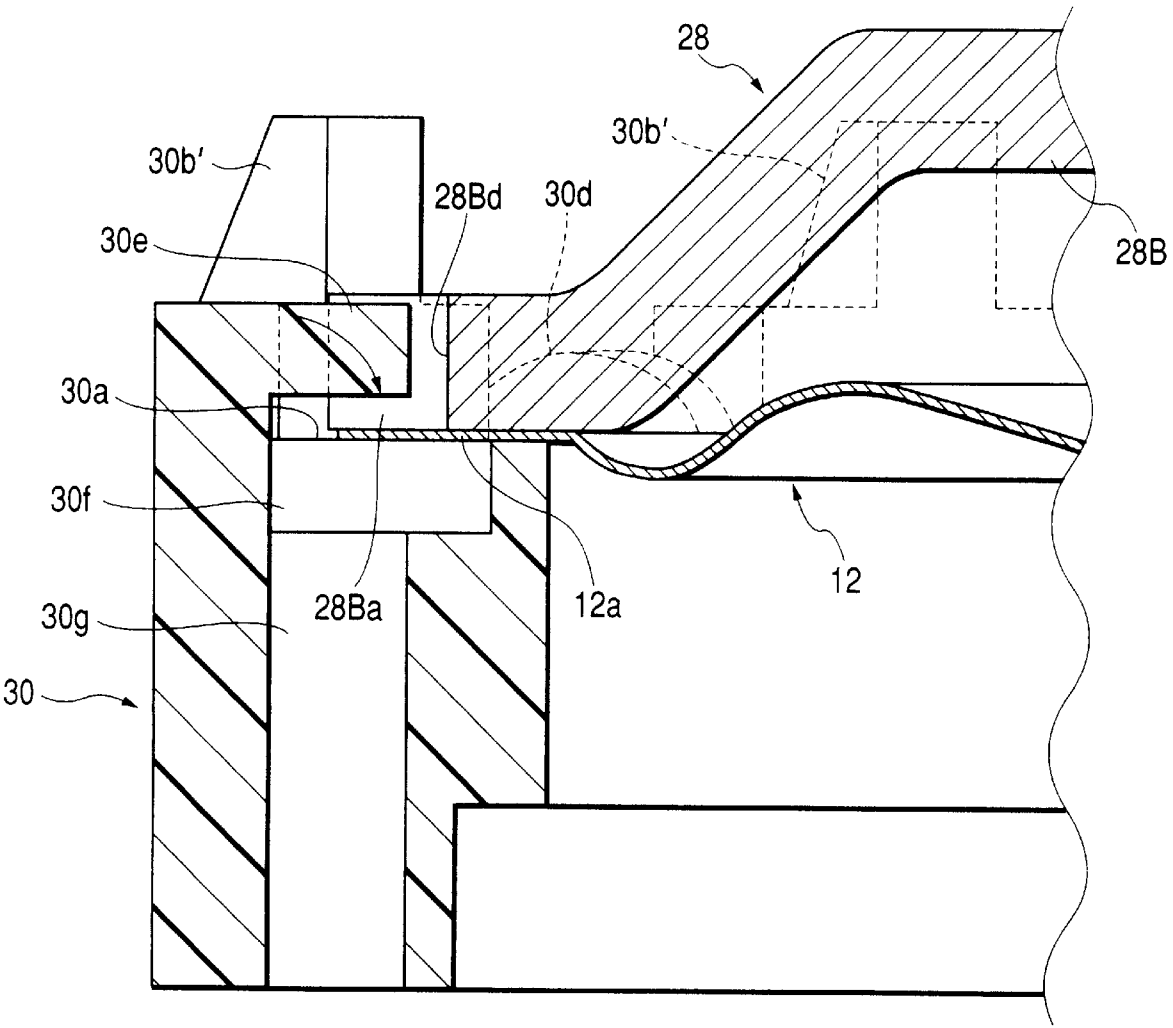
FIG. 8 is a detailed sectional view taken along line VIII-VII in FIG. 6.

As FIG. 8 shows, a groove 30*f* is formed around the circumferential direction positioning pieces 30*e* of the ring 30, and a vertically penetrating hole 30*g* is formed above (below in the figure) the circumferential direction positioning pieces 30*e*. This allows the circumferential direction positioning pieces 30*e* to be accurately formed and the ring 30 to be molded without the need for a slide die.

Lastly, after the magnet 20 of the magnetic circuit unit 18 is magnetized, the long legs 32*b* of the terminal pins 32 are bent to engage with the terminal engagement grooves 30*h*2 of the flange 30*h* on the ring 30 to finalize the speaker 10.

As shown in the foregoing detailed description, the speaker 10 related to the embodiment comprises the frame 14 which supports the diaphragm 12 by its outer periphery. The frame comprises the ring 30 corresponding to the shape of the outer periphery of diaphragm 12 and the mounting portion 28B which extends radially outward from the magnetic circuit unit 18. The ring 30 is caulked-jointed to the mounting portion 28B with the diaphragm 12 to be clamped between the ring 30 and the mounting portion 28B, thereby providing the following effects and functions.

Since the diaphragm 12 is clamped between the ring 30 and the mounting portion 28B which are caulked-jointed together, the supporting strength offered by the frame 14 for diaphragm 12 is significantly increased as compared to the conventional method wherein the diaphragm is attached to the frame using only adhesives. This in turns reliably prevents the diaphragm 12 from separating from the frame 14 during the use of the speaker.

Furthermore, since the task of applying the adhesives required in the conventional method is eliminated, the automation of the speaker fabrication process is facilitated. Moreover, because the process of adjusting the viscosity of the adhesives or drying the adhesives after their application is eliminated, the speaker manufacturing process is simplified.

In the foregoing manner, the embodiment reliably prevents the separation of the diaphragm from the frame, and promotes and facilitates the automation of the speaker manufacturing process.

Because of the above reasons, the speaker 10 according to the embodiment can fully stand up to use in environment such as automotive use where the speaker is subjected to much shock and high impact loads.

Even though in the embodiment the diaphragm 12 is simply clamped between ring 30 and mounting portion 28B which are caulked-jointed together, there is no risk of an acoustically detrimental deformation of the diaphragm arising from the use of the caulking construction since the diaphragm 12 itself plays no role in the caulked-joint.

In particular, because with the embodiment, the ring 30 is made of synthetic resin with a plurality of the caulking portions 30*b*', and they are subject to thermal deformation by ultrasonic vibrations to be turned into the caulking portions 30*b*, the caulking can be easily and securely performed despite the speaker 10 being a small speaker with extremely small caulking portions 30*b*'.

Since the ultrasonic vibrations are used for the thermal deformation of the caulking portions 30*b*' without need for an ultrasonic welding of the ring 30 and the mounting portion 28B, there is no need to give any consideration to the welding compatibility of the materials used for the two pieces. This means that the use of a thermal deformation induced by exposure to ultrasonic vibrations imposes no limitations on the degree of freedom in the selection of the materials to be used for the ring 30 and the mounting portion 28B. Needless to say, the degree of freedom in the selection of the material for the diaphragm 12 is not restricted in any way since the diaphragm plays no role in the caulked-joint.

Moreover, since in the embodiment the ring 30 is caulked-jointed to the diaphragm 12 by the plastic deformation of caulking portions 30*d*' formed on the ring 30 to form the caulking portion 30*d*, the following effects and functions are obtained.

The ring 30 is temporarily fixed to diaphragm 12 before the ring 30 and mounting portion 28B are caulked-jointed. This allows the diaphragm 12 to be positioned at the prescribed spot when it is clamped down by the caulking of the two pieces. If the temporary attachment is performed by caulking, the diaphragm 12 can be positioned without impeding the promotion or facilitation of the automation of the speaker manufacturing process.

Moreover, since the plastic deformation of the ring 30 is accomplished by the thermal deformation of the caulking portions 30*d*' on the ring 30 by exposure to ultrasonic vibrations, the same effects and functions are obtained as provided with the use of ultrasonic vibrations for the caulking of the ring 30 and the mounting portion 28B.

Furthermore with the embodiment, since the circumferential direction positioning piece 30*e* is formed on the ring 30 so as to align the ring 30 and the mounting portion 28B in the circumferential direction, the caulking of the ring 30 and the mounting portion 28B can be done at different angular positions from the caulking portion 30*d* and the cut-away portions 28B*c*.

Additionally, with the embodiment, since the voice coil 16 is secured to the diaphragm 12 by the caulking of the coil supporting member 26, the use of an adhesive process is entirely eliminated from the manufacturing process for the speaker 10, greatly improving the manufacturing productivity of speaker 10.

With the embodiment, even though the ring 30 is made of synthetic resin and the caulking of the ring 30 to the mounting portion 28B is accomplished by the application of ultrasonic vibrations and the consequential thermal deformation of the caulking portions 30*b*' formed on the ring 30, other caulking construction methods can be used.

As one example, it is possible to construct the base 28 comprising two separate members screwed to each other; one is a cylinder portion made of steel and the other is a mounting portion made of synthetic resin. Then caulking portions may be formed on the mounting portion to achieve the caulked-joint above described.

Alternatively, instead of the two separate members, it is possible to use insert molding to integrally form the cylinder portion made of steel and the mounting portion made of synthetic resin. Furthermore even though the embodiment is explained for the case where speaker 10 is a small speaker, any construction similar to that of the above-described embodiment will provide the same functions and effects.

What is claimed is:

1. A speaker comprising:

a diaphragm;

a magnetic circuit unit defining a cylindrical magnetic gap;

a voice coil having a first portion fixed to the diaphragm and a second portion placed in the cylindrical magnetic gap; and a frame for supporting the outer periphery of the diaphragm, wherein the frame comprises an annular ring formed along with the shape of the outer periphery of the diaphragm and a mounting portion extending radially outward from the magnetic circuit unit; and the ring and the mounting portion are caulked-jointed to each other with the diaphragm clamped therebetween, wherein a caulking portion is formed on a lower surface of the ring, so that an annular flat portion of the mounting portion fits between the lower surface and the caulking portion of the ring.

2. The speaker as claimed in claim 1, wherein at least one of the ring and the mounting portion is made of synthetic resin having a plurality of protrusions; and ultrasonic vibrations are applied to the plurality of protrusions for thermal deformation.

3. The speaker as claimed in claim 2 wherein a circumferential direction positioning portion is formed on at least one of the ring and the mounting portion to position the ring and the mounting in the circumferential direction.

4. The speaker as claimed in claim 1 or 2 wherein the ring is caulked-jointed to the diaphragm by plastic deformation of the plurality of protrusions formed on the ring.

5. The speaker as claimed in claim 4 wherein the ring is made of synthetic resin; and the plastic deformation of the ring is accomplished by the exposure to ultrasonic vibrations.

6. The speaker as claimed in claim 4 wherein a circumferential direction positioning portion is formed on at least one of the ring and the mounting portion to position the ring and the mounting in the circumferential direction.

7. The speaker as claimed in claim 5 wherein a circumferential direction positioning portion is formed on at least one of the ring and the mounting portion to position the ring and the mounting in the circumferential direction.

8. The speaker as claimed in claim 1 wherein a circumferential direction positioning portion is formed on at least one of the ring and the mounting portion to position the ring and the mounting in the circumferential direction.

9. A speaker comprising:

a diaphragm;

a magnetic circuit unit defining a cylindrical magnetic gap;

a voice coil having a first portion fixed to the diaphragm and a second portion placed in the cylindrical magnetic gap; and a frame for supporting the outer periphery of the diaphragm, wherein the frame comprises an annular ring formed along with the shape of the outer periphery of the diaphragm and a mounting portion extending radially outward from the magnetic circuit unit;

the ring and the mounting portion are jointed with the diaphragm clamped therebetween; and a plurality of protrusions are formed on one of the ring and the mounting portion, and subjected to plastic deformation to caulk-joint the ring or the mounting portion to the diaphragm, wherein the plurality of protrusions include alternating narrow and wide caulking portions, the narrow caulking portions joining the diaphragm thereto, and the wide caulking portions joining the ring or the mounting portion to the diaphragm.

* * * * *